US009185991B2

(12) United States Patent
Owens

(10) Patent No.: US 9,185,991 B2
(45) Date of Patent: Nov. 17, 2015

(54) UNI-DIRECTIONAL RIGIDIFIER AND METHOD

(71) Applicant: W. Neil Owens, Denton, NC (US)

(72) Inventor: W. Neil Owens, Denton, NC (US)

(73) Assignee: Axess Direct, Inc., Asheboro, NC (US)

( * ) Notice: Subject to any disclaimer, the term of this patent is extended or adjusted under 35 U.S.C. 154(b) by 65 days.

(21) Appl. No.: 14/143,246

(22) Filed: Dec. 30, 2013

(65) Prior Publication Data

US 2015/0182029 A1 Jul. 2, 2015

(51) Int. Cl.

| | |
|---|---|
| ***A47C 23/02*** | (2006.01) |
| ***A47C 17/13*** | (2006.01) |
| ***A47C 19/02*** | (2006.01) |

(52) U.S. Cl.

CPC ..... *A47C 23/02* (2013.01); *A47C 17/134* (2013.01); *A47C 19/027* (2013.01)

(58) Field of Classification Search

CPC ..... A47C 23/02; A47C 17/32; A47C 17/134; A47C 19/027

USPC ..... 5/719; 267/103

See application file for complete search history.

(56) References Cited

U.S. PATENT DOCUMENTS

| | | | | | |
|---|---|---|---|---|---|
| 208,979 | A | * | 10/1878 | Lattin | 5/242 |
| 224,846 | A | * | 2/1880 | Ransom | 5/237 |
| 2,302,479 | A | * | 11/1942 | Tallmadge | 267/103 |
| 2,378,877 | A | * | 6/1945 | Waller | 114/102.27 |
| 2,473,365 | A | * | 6/1949 | Emberson | 267/103 |
| 2,608,172 | A | * | 8/1952 | Biuw | 114/102.27 |
| 2,827,952 | A | * | 3/1958 | Propst | 267/103 |
| 3,716,875 | A | * | 2/1973 | Fehr | 5/655.7 |
| 3,871,035 | A | | 3/1975 | Gerth | 5/13 |
| 4,377,279 | A | | 3/1983 | Schulz, Jr. et al. | 267/103 |
| 4,381,570 | A | | 5/1983 | Schneider | 5/13 |
| 4,633,798 | A | * | 1/1987 | Skinner et al. | 114/107 |
| 4,654,905 | A | | 4/1987 | Miller | 5/249 |
| 4,811,932 | A | | 3/1989 | Miller | 267/95 |
| 4,922,562 | A | * | 5/1990 | Allred et al. | 5/627 |
| 5,056,449 | A | * | 10/1991 | Howlett | 114/102.27 |
| 5,257,424 | A | | 11/1993 | Rogers | 5/13 |
| 5,364,082 | A | | 11/1994 | Miller | 267/108 |
| 5,524,305 | A | | 6/1996 | Miller | 5/267 |
| 5,535,460 | A | | 7/1996 | Miller | 5/269 |
| 5,539,940 | A | | 7/1996 | Miller | 5/13 |
| 5,539,944 | A | | 7/1996 | Miller | 5/475 |
| 5,540,418 | A | | 7/1996 | Miller | 267/95 |
| 5,551,104 | A | | 9/1996 | Hartline | 5/13 |
| 5,642,536 | A | | 7/1997 | Miller | 5/13 |
| 5,655,240 | A | | 8/1997 | Miller | 5/717 |
| 6,012,190 | A | | 1/2000 | Rogers | 5/722 |

(Continued)

OTHER PUBLICATIONS

Co-pending U.S. Appl. No. 13/470,458, filed May 14, 2012, 27 pgs.

(Continued)

*Primary Examiner* — Robert G Santos
*Assistant Examiner* — Myles Throop
(74) *Attorney, Agent, or Firm* — Blake P. Hurt; Tuggle Duggins P.A.

(57) ABSTRACT

A uni-directional rigidifier for a foldable mattress for use in sofa beds has an arcuate, elongated shape. Lateral slits along the rigidifier allow it to easily flex when a load is applied while in an upright position. When the rigidifier is in an inverted position, an applied load causes the slits to close and the rigidifier to stiffen. The method describes the use of the uni-directional rigidifier in a foldable sofa bed mattress.

11 Claims, 4 Drawing Sheets

(56) References Cited

U.S. PATENT DOCUMENTS

| | | | | |
|---|---|---|---|---|
| 7,487,564 | B2 | 2/2009 | Miller | 5/716 |
| 7,726,636 | B2 | 6/2010 | Miller | 267/144 |
| 7,979,930 | B2 | 7/2011 | Miller | 5/2.1 |
| 2012/0111254 | A1 * | 5/2012 | Waldhauser et al. | 114/95 |
| 2013/0186320 | A1 * | 7/2013 | Primrose et al. | 114/102.15 |

OTHER PUBLICATIONS

Co-pending U.S. Appl. No. 13/470,478, filed May 14, 2012, 27 pgs.

* cited by examiner

UNI-DIRECTIONAL RIGIDIFIER AND METHOD

FIELD OF THE INVENTION

The invention herein pertains to tension members and particularly pertains to arcuate spring members for use in sofa beds.

DESCRIPTION OF THE PRIOR ART AND OBJECTIVES OF THE INVENTION

Various types of tension members have been used in furniture seats and sofa mattresses for many years. Coil, sinuous, and flat or leaf springs have often been employed to provide comfort for the user. A foldable mattress that employs springs must carefully balance the tension so that the user is comfortable both while sitting with the mattress folded in sofa mode and while the user is in a prone position with the mattress unfolded or extended in bed mode. A sofa mattress that is either "too hard" or "too soft" brings discomfort and causes loss of sleep. Therefore to address the problem of providing the optimum tension and comfort in a sofa mattress, the present invention was conceived and one of its objectives is to provide a uni-directional rigidifier formed from an arcuate tension member which can be easily fitted and attached within a foldable mattress for a sofa bed.

It is another objective of the present invention to provide an elongated tension member for a sofa bed mattress which can lock or close to stiffen when in the bed mode and which will provide flexing when in the sofa mode.

It is still another objective of the present invention to provide a tension member which includes a series of lateral slits therealong to provide exceptional locking and stiffening ability.

It is yet another objective of the present invention to provide a tension member which is conventionally stamped and formed from coated sheet steel.

It is a further objective of the present invention to provide an elongated tension member which can be easily affixed within a sofa bed mattress for improved comfort in both the sofa and bed modes.

It is still a further objective of the present invention to provide a tension member which is relatively inexpensive to manufacture and install.

It is yet a further objective of the present invention to provide an elongated tension member having a U-shaped cross-section with lateral slits therein capable of flexing in a single direction.

Various other objectives and advantages of the present invention will become apparent to those skilled in the art as a more detailed description is set forth below.

SUMMARY OF THE INVENTION

The aforesaid and other objectives are realized by providing uni-directional rigidifiers formed from arcuate tension members which extend longitudinally and have a U-shaped cross-section. In the upright position as a load is applied such as with an individual sitting on the folded mattress in the sofa mode, the tension members flex and the lateral slits open for seating comfort. When the mattress is unfolded in the usual bed mode the tension members are inverted and when a load is applied such as when an individual lays on the unfolded mattress, the lateral slits therealong close and therefore stiffen to prevent further flexing. Thus the tension members provide the best support and comfort for both sofa seating and bed modes.

The method of use described herein further demonstrates the benefits and advantages of the arcuate tension member. The tension member is formed with a plurality of lateral slits which allow flexing when pressure is applied to the tension member, such as while in the sofa mode. A sofa mattress can be fitted with a suitable number of tension members, such as by attachment to the spring assembly, or otherwise contained within the sofa bed mattress. Unfolding the mattress for use in the bed mode presents the tension members in an inverted configuration whereupon applying a load (pressure) to the mattress causes the slits to close, stiffening the mattress for the user.

DETAILED DESCRIPTION OF THE PREFERRED EMBODIMENT AND OPERATION OF THE INVENTION

Figure 1:
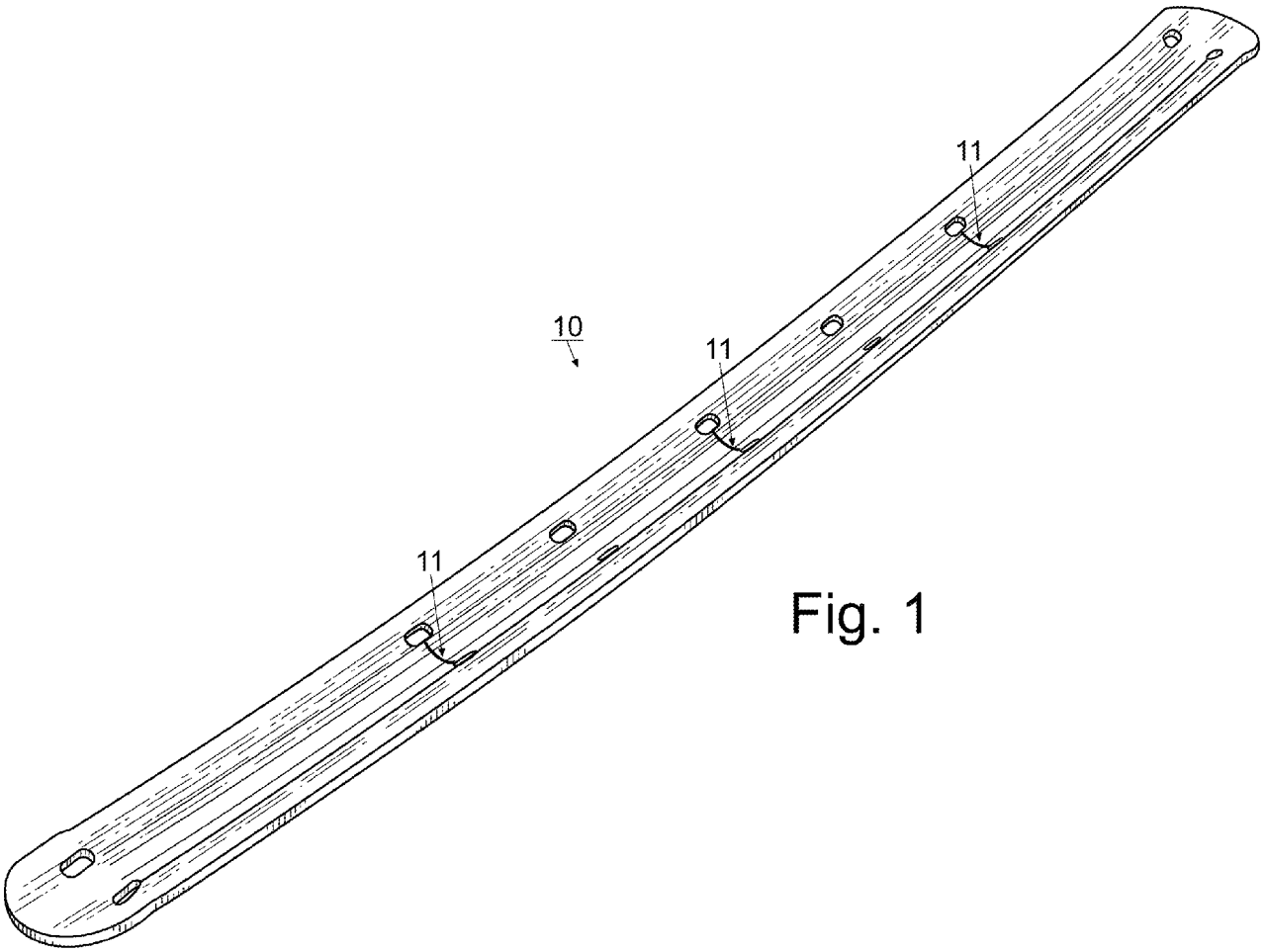
FIG. 1 shows the elongated, arcuate tension member of the invention in an upright, relaxed perspective view.
Figure 2:
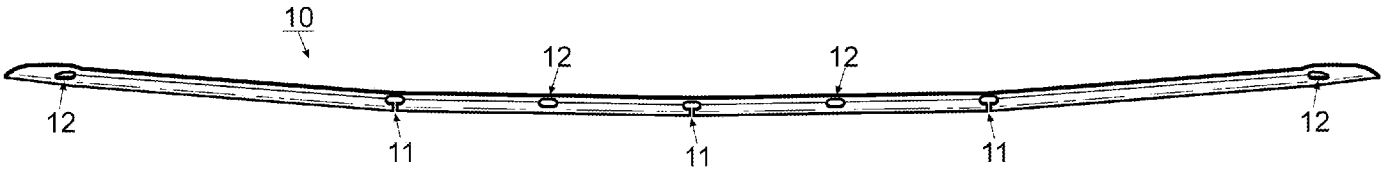
FIG. 2 pictures the tension member as seen in FIG. 1 in a right side elevational view depicting the elongated arc, the left side elevational view being a mirror image thereof.
Figure 3:
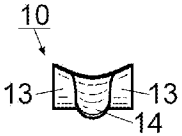
FIG. 3 depicts a right end view of the tension member as shown in FIG. 2, the left end view being a mirror image thereof.
Figure 4:
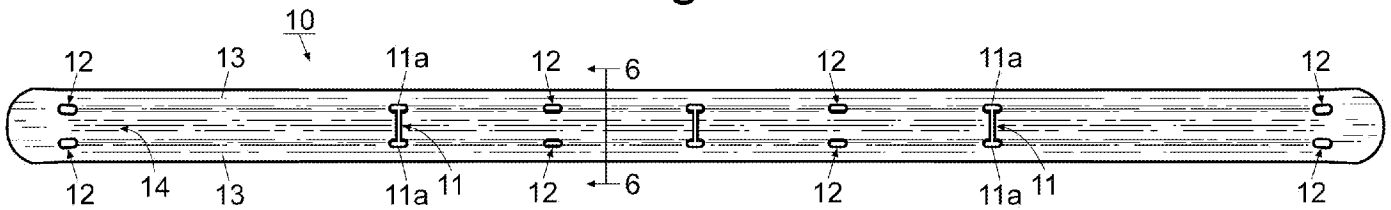
FIG. 4 demonstrates a top view of the tension member as shown in FIG. 2.
Figure 5:
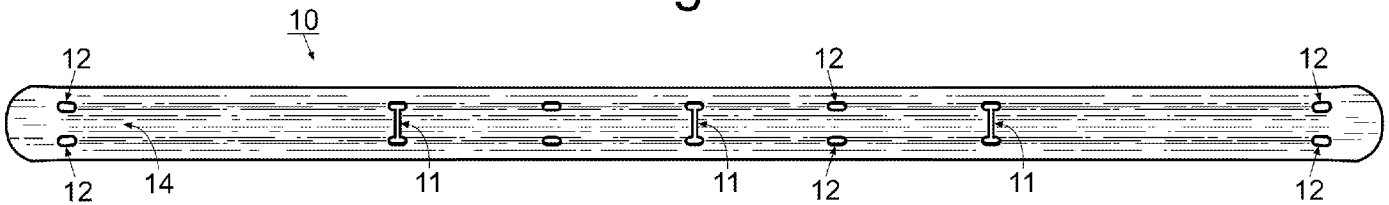
FIG. 5 illustrates a bottom view of the tension member as shown in FIG. 4.
Figure 6:
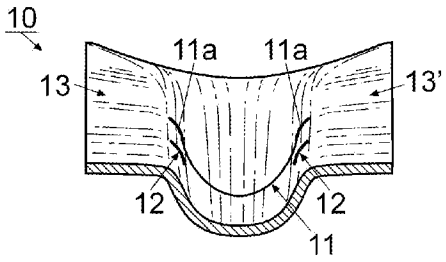
FIG. 6 features a cross-sectional view of the tension member generally as along lines 6-6 of FIG. 4.

For a better understanding of the invention and its operation, turning now to the drawings, FIG. 1 illustrates a perspective view of a preferred uni-directional rigidifiers presented as elongated tension members 10 having a plurality of lateral slits 11 spaced therealong. In the side view as shown in FIG. 2, slits 11 are only slightly open when tension member 10 is in its relaxed, arcuate configuration. Openings 12 allow for screws, bolts, wires, springs, zip ties or other fasteners to be used to affix tension member 10 to the spring assembly inside mattress 21, cushion or the like as shown schematically in FIGS. 9 and 10. Tension member 10 includes opposing lips 13, 13' which are relatively flat and act as top edges along the sides of U-groove 14 as seen in FIGS. 3 and 6. In FIG. 5 which portrays the bottom view of tension member 10, open slits 11 are easily seen though tension member 10 is not under pressure such as by the weight of a user. As seen in FIGS. 4 and 5, slits 11 include apertures 11*a* on each end which are in communication therewith and provide pressure relief to tension member 10 as slits 11 close and open during use to prevent damage such as bending, creasing, stress fractures or the like to the surrounding edges.

Preferred tension member 10 has a U-shaped cross-section as seen along lines 6-6 of FIG. 4 and is formed such as by a conventional stamping process from usual metal such as a thin coated steel. Tension member 10 is formed from twenty (20) gauge (0.8 mm thick) coated steel although other thicknesses and materials such as plastics, aluminum or composite materials if suitable may be employed. Tension member 10 was created to provide comfort to the user while extending the life of a mattress and as such must be formed from a durable material which will sustain its shape during repeated use over an extended time period. The preferred length of tension member 10 is preferably twenty-two inches (55.88 cm) with a width of one and a half inches (3.81 cm) although other lengths and widths may be used, depending on the particular application and specifications desired.

Figure 7:
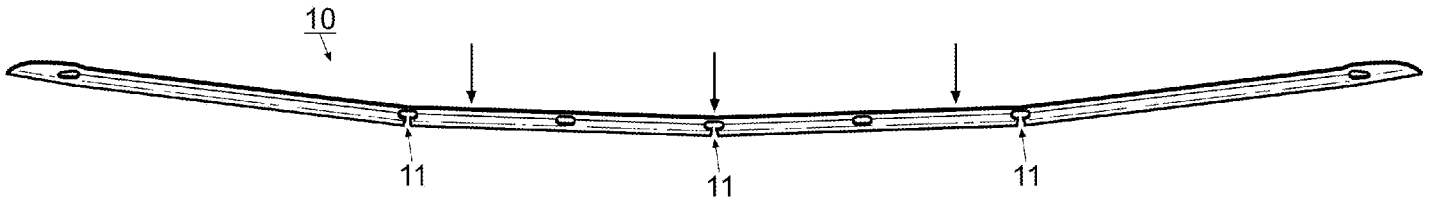
FIG. 7 shows in schematic fashion the flexing of the tension member as shown in FIG. 2 when a load is applied.
Figure 8:
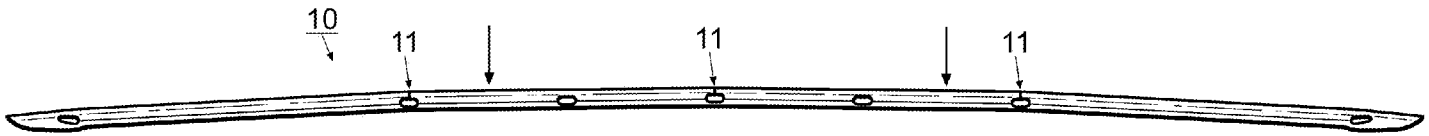
FIG. 8 illustrates the tension member in an inverted posture with the slits closed due to the applied load.
Figure 9:
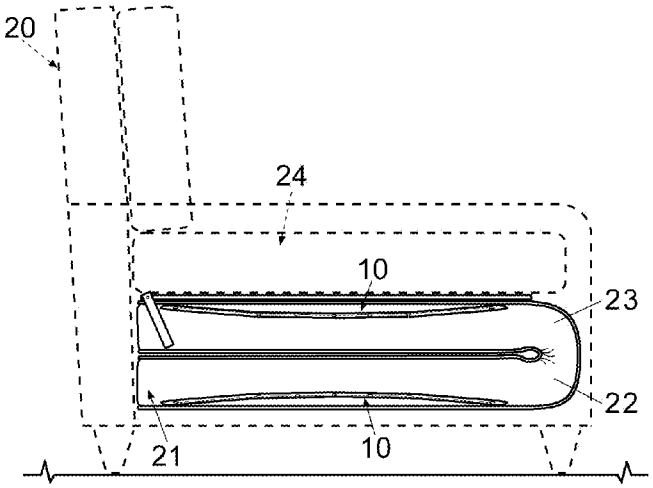
FIG. 9 depicts a schematic side elevational view of a typical foldable mattress of a sofa bed in the sofa mode with tension members positioned within the mattress.
Figure 10:
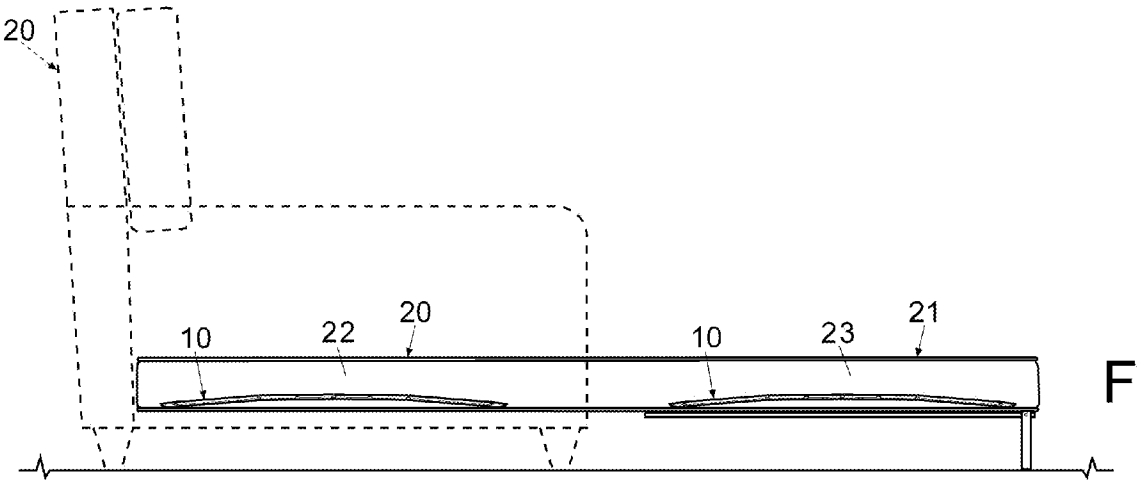
FIG. 10 demonstrates the foldable mattress of FIG. 9 in an extended or unfolded posture in the bed mode with the inverted tension members shown therein.

A plurality of tension members 10 can be positioned for example in a foldable mattress of a sofa bed such as sofa bed 20. For example, see co-pending application Ser. No. 13/470,458 and Ser. No. 13/470,478, the entire disclosures of each are hereby incorporated by reference in their respective entireties. As shown in FIGS. 9 and 10, sofa bed 20 includes a standard foldable mattress 21 having at least lower or first section 22 and folded or second section 23. As seen in FIG. 9 in the sofa mode, tension members 10 are in an upright position in folded or second section 23 which is shown folded atop lower or first section 22 which includes tension members 10 in an inverted position. Second section 23 in FIG. 9 is shown directly below seat cushion 24. In FIG. 9, if sofa bed 20 is used for seating and seat cushion 24 above mattress 21 is sat upon, upright tension member 10 in second section 23 will flex and slits 11 as shown in FIG. 7 will open allowing some give (flexing) in mattress 21 providing comfort to the user. Tension members 10 in lower or first mattress section 22 will stiffen due to the closure of slits 11 therealong (see FIG. 8) as a load is applied, such as by sitting thereon to prevent further downward movement.

In FIG. 10, sofa bed 20 is shown with seat cushions 24 removed and foldable mattress 21 in its extended posture for use as a bed. Tension members 10 in first section 22 and second section 23 are positioned proximate the bottom of mattress 21 and are both inverted as shown larger in FIG. 8. Thus, when a load is applied to first section 22 or second section 23 such as a person laying thereon, tension members 10 stiffen due to slits 11 closing as seen in FIG. 8 thus stopping the flexion of tension members 10 to provide a firm support.

As would be understood the upper portion of mattress 21 as is conventional allows for some deformation when a user lays thereon. However over time and extended, repeated use, the mattress and spring assembly (not shown) begin to flatten or sag and can provide an unstable, uncomfortable mattress for the user. By positioning tension members 10 within sofa mattress 21, an additional stiffening structure is provided to assist in supporting the spring assembly/mattress and will prevent sagging and "bottoming out" of the mattress as often occurs over time after repeated use. Tension members 10 provide support not only for the user but also for the mattress itself to maintain its posture and ultimately extend its "shelf life".

In the method of use, one or more uni-directional rigidifiers shown as tension members 10 are formed such as by usual stamping from coated steel and installed in a suitable, conventional foldable mattress such as mattress 21 for use such as in sofa bed 20 as illustrated in FIGS. 9 and 10. Foldable mattress 21 is positioned as normal in sofa bed 20 with usual removable back and seat cushions. As seat cushions 24 are loaded or pressure is applied such as by an individual (not shown) sitting thereon, tension member 10 in second (upper) mattress section 23 flexes (with slits 11 opening) to provide comfort to the user. Lower or first mattress section 22 having tension member 10 inverted will only slightly flex causing slits 11 to close preventing further flexing. Next, when using sofa bed 20 as a bed, seat cushions 24 are removed and second section 23 which is hingedly joined to first section 22 is unfolded or extended as seen in FIG. 10 whereby tension members 10 in both first section 22 and second section 23 are inverted. Here, as a person lays upon mattress 21, the upper portion would deform downwardly as is conventional however tension members 10 in both first section 22 and second section 23 would stiffen as a load or pressure is applied causing lateral slits 11 to close, thus effectively locking tension members 10 and preventing further flexing or downward deformation of mattress 21. Such placement allows for a firmer mattress providing comfort to the user while also preventing sagging of the mattress. Although not shown as would be understood a plurality of tension members 10 are evenly spaced in an asymmetrical and parallel relation approximately five inches (12.7 cm) apart along the width of mattress 21 for a total of six (6) tension members 10 in both first and second sections 22, 23 respectively to provide additional stiffening support to mattress 21.

The illustrations and examples provided herein are for explanatory purposes and are not intended to limit the scope of the appended claims.

I claim:

1. A uni-directional rigidifier formed from a flexible tension member, said tension member defining an arcuate elongated shape, said tension member defining a lateral slit and a pair of opposing slit apertures, said pair of opposing slit apertures in communication with said lateral slit, said lateral slit closing upon flexing said tension member in one direction and opening said lateral slit upon flexing said tension member in an opposite direction.

2. The tension member of claim 1 further defining a U-shaped cross-section.

3. The tension member of claim 1 wherein said tension member defines an additional lateral slit.

4. The tension member of claim 1 further comprising a flat lip, said lip extending longitudinally therealong.

5. The tension member of claim 1 formed from twenty gauge steel.

6. The tension member of claim 1 wherein said tension member defines an opening, said opening for affixing said tension member to a foldable sofa mattress.

7. The tension member of claim 1 further defining a pair of opposing openings, said pair of opposing openings positioned in opposing parallel relation to said pair of opposing slit apertures.

8. The tension member of claim 7 further comprising a pair of opposing lips, said pair of opposing lips extending longitudinally therealong.

9. The tension member of claim 1 whereby said arcuate elongated shape defines a continuous edge.

10. The tension member of claim 1 defining three lateral slits and a pair of opposing slit apertures in communication with each lateral slit.

11. The tension member of claim 1 wherein said slit apertures each define a radius greater than a width of the slit.

* * * * *